United States Patent [19]

Boardman

[11] Patent Number: 5,039,840

[45] Date of Patent: Aug. 13, 1991

[54] METHOD OF PRODUCING ELECTRICAL HEATING ELEMENTS AND ELECTRICAL HEATING ELEMENTS SO PRODUCED

[75] Inventor: Jeffery Boardman, Warrington, England

[73] Assignee: Deeman Product Development Ltd., Chester, England

[21] Appl. No.: 463,237

[22] Filed: Jan. 10, 1990

[51] Int. Cl.[5] ..... B05D 1/02

[52] U.S. Cl. ..... 219/270; 219/543; 338/308; 29/611; 427/58

[58] Field of Search ..... 219/270, 262, 267, 543; 29/611, 620; 427/58, 59; 338/308, 309

[56] References Cited

U.S. PATENT DOCUMENTS

| | | | |
|---|---|---|---|
| 1,932,193 | 10/1933 | Spiselman et al. | 219/262 |
| 3,737,624 | 6/1973 | Eilenberger | 338/308 |
| 3,811,934 | 5/1974 | Glaser | 338/308 |
| 3,872,419 | 3/1975 | Groves et al. | 338/308 |
| 4,348,433 | 9/1982 | Kammer et al. | 420/450 |
| 4,348,434 | 9/1982 | Kammer et al. | 420/435 |
| 4,513,020 | 4/1985 | Dickson et al. | 75/356 |
| 4,587,402 | 5/1986 | Nishino et al. | 338/308 |

FOREIGN PATENT DOCUMENTS

| | | | |
|---|---|---|---|
| 2134008 | 8/1984 | United Kingdom | 427/58 |

*Primary Examiner*—Bruce A. Reynolds

*Assistant Examiner*—John A. Jeffery

*Attorney, Agent, or Firm*—Anthony J. Casella; Gerald E. Hespos

[57] ABSTRACT

A method of forming an electrical heating element in the form of an electrically non-conductive supporting body onto which an electrically resistive material is deposited, the method comprising the steps of preparing a dry metal powder of irregularly shaped metal particles of widely varying sizes, in the range 20–150 microns, roughening the surface of a supporting body onto which a heating element is to be formed, pre-heating said surface of the supporting body to a temperature within the range of 150°–250° C. and flame spraying the dry metal powder onto said heated surface of the supporting body in a plurality of passes over the supporting body. The effective resistivity of the flame sprayed deposit is predetermined by adjusting the amount of oxidation on the surfaces of the metallic particles sprayed onto the supporting body. The amount of oxidation on the surfaces of the flame sprayed particles, and hence the resistivity of the sprayed deposit, can be varied by selecting the size range of the particles used, within said range of 20–150 microns. Alternatively the amount of oxidation on the surfaces of the flame sprayed particles can be varied by blending selected alloys into the powder to be sprayed such as to adjust the quantity of conductive oxides present on the sprayed particles.

17 Claims, 2 Drawing Sheets

METHOD OF PRODUCING ELECTRICAL HEATING ELEMENTS AND ELECTRICAL HEATING ELEMENTS SO PRODUCED

The present invention is concerned with a method for producing electrical heating elements, that is electrically energised heating elements of the type which rely upon the passage of an electric current through a resistive medium to transform electrical energy into heat energy. The invention also encompasses electrical heating elements when produced by the new method.

Conventional electrical heating elements are usually in the form of an elongate resistive member, such as the ribbon element commonly used in an electric toaster or the spirally wound wire of an electric heater, supported on an electrically non-conductive medium, such as a plate of mica in the case of a toaster or a rod of a ceramics material in the case of an electric heater. In all such cases, the elongate resistive member is pre-formed and is later mounted onto the non-conductive supporting member to form the heating element.

It has been realised for some time that there would be considerable advantage in having resistive heating mediums incorporated integrally onto supporting electrically non-conducting bodies so as, for example, to eliminate the necessity for a separate filament member and to spread the electrical load and the resulting heating effect more evenly over a larger effective surface area.

A number of techniques have been developed to this end, all of which seek to apply a coating of a partially electrically conductive material to a non-conducting substrate. Practical problems are, however, incurred in achieving a commercially viable production technique based on this basic proposition. Firstly, there is the problem of achieving a lasting bonding between the resistive medium and the substrate that will stand up to continued and repeated operation, where the resistive medium is required to be heated to several hundred degrees centigrade repeatedly over a long period without deterioration, both in regard to its mechanical configuration and its electrical characteristics. Secondly, there is the problem of obtaining a required, predetermined resistivity/temperature characteristic for a given heating element, which will be maintained over a reasonable operating life without unacceptable variation and failure rate.

One way of applying such a resistive coating to a substrate which has been tried is to apply it in the form of a liquid paint which is printed on the substrate in a desired pattern (EP 208808). This technique has the problem, however, that it is difficult to achieve the correct thickness of paint covering in order to achieve a required resistivity for the resulting heating element.

A more convenient technique commercially, which has also been tried, is flame spraying wherein metallic alloy powders are introduced into a gas flame in a flame spraying gun and sprayed, in a semi-molten state, onto an insulating substrate which has been pre-roughened and pre-heated. Typically, the alloy powders are based on NiCr since this is cheap and readily available. In order to achieve adherence of the sprayed particles onto the substrate, the particles used have been very small, typically between 1–10 μm.

One technique which has been adopted (EP 147170) to achieve a required resistivity has been to incorporate in the alloy powder a proportion of an insulating ceramic powder, such as $Al_2O_3$, MgO, $Y_2O_3$ or $SiO_2$.

The insulating ceramic powder and NiCr powder are uniformly mixed and are of generally the same particle size.

The present invention seeks to provide an alternative technique which does not involve the use of insulating ceramic powders and which enables a wide variation in the operational resistivity/temperature characteristics to be pre-selected to suit the operation that a given heater element is required to perform and to suit the environment in which it is to operate.

In accordance with the present invention, there is provided a method of forming an electrical heating element in the form of an electrically non-conductive supporting body onto which an electrically resistive material is deposited, the method comprising the steps of:

(1) preparing a dry metal powder of irregularly shaped metal particles of widely varying sizes, in the range 20–150 μm;

(2) roughening the surface of a supporting body onto which a heating element is to be formed;

(3) pre-heating said surface of the supporting body to a temperature within the range of 150°–250° C.; and (4) flame spraying the dry metal powder onto said heated surface of the supporting body in a plurality of passes over the supporting body.

The important new steps in this method reside (a) in the use of metallic particles which are of irregular shape and (b) in the use of metal particles which are of widely differing sizes, within a specified range. It should be emphasised in this connection that when the particles are specified herein to be within a given particle size range, a small proportion may inevitably fall outside that range, particularly at the lower end of the range where, when metal particles are produced, some formation of smaller metal "dust" particles can be inevitable.

In referring herein to the particles being of "widely differing sizes" within a specified range, it is intended to mean that, within that specified particle range, there are substantial numbers of particles in a plurality of notional sub-ranges within said specified range. In a specific example, the variation in particle size would be spread approximately evenly over the specified size range.

Furthermore, in referring to the particles being of "irregular shape", it is intended to mean that the particles are of non-uniform shape, in particular they are not all spherical.

As explained briefly hereinbefore, one of the problems associated with the formation of a partially conductive coating on a non-conductive substrate lies in achieving the adhesion of the conductive particles one to another and the adhesion of the conductive particles to the substrate in a manner which will survive the repeated rise and fall of several hundred degrees centigrade in the temperature of the coating, without significant change in its operational characteristics. It has been found that if powders consisting of particles of widely differing size and of irregular shape are used, the result, following flame spraying, is a mechanical interlocking of the particles one to another and to the substrate. This effect can be observed by electron microscope inspection and is illustrated very diagrammatically in FIG. 4*b* of the accompanying drawings, which shows how irregular particles interlock, particularly as a result of the re-entrant effect of their irregularities. In FIG. 4*b*, the sprayed layers 100 on the substrate 102 consists of irregular particles 104, each having a surface oxide layer 106. The surface of the sprayed layer is indicated at 108. An oxide layer 110 also forms on the substrate surface 112. On the other hand, when conventional powders are used for flame spraying as illustrated in FIG. 4*a*, where the vast majority of the particles 104' are of similar size and of regular shape so that voids 112 exist between adjacent particles, then this interlocking effect is not observed and the conductive layer tends to break up after a short period of use and its resistivity characteristic does not remain sufficiently constant.

A preferred method of achieving particles of irregular shape and widely differing size is to use water atomised powder, wherein alloy powder particles are melted and, in molten form, are blasted into water. The water atomised powder is subsequently "crushed" and dried.

It is found that in practice heating elements of the present type must exhibit different resistivity/temperature characteristics depending upon the function they are required to perform, e.g. heater elements for use as toaster elements, trouser press elements, convector heater elements and heater panels are all required to have different operational resistivity characteristics. A means is needed therefore to enable such characteristics to be modified and pre-selected to suit a given operational function. For example, some heating elements may need a flat characteristic where the resistivity is substantially constant over its operating temperature range whereas other heating elements may be required to exhibit progressively increasing or decreasing resistivity with rise in temperature.

It has been discovered by the present Applicant that one way in which the effective resistance (resistivity) of the conductive layer applied by flame spraying can be controlled is by adjusting the amount of oxidation on the surfaces of the metallic particles sprayed onto the substrate.

In accordance with a further aspect of this invention, it has been discovered that the amount of oxidation on the surfaces of the sprayed particles, and hence the resistance of a given thickness of sprayed deposit, can be varied over a wide range simply by selecting the size range of particles used.

For example, the resistance can be increased by using fine particles of say, 25 to 45 microns and finer, or decreased by selecting a size range of 80–110 microns. Alternatively, a standard particle size range powder of 45–110 microns can be mixed with finer powders, 20–40 microns in proportions of 9:1, 8:2, etc., to vary the resistance to meet a particular requirement.

The explanation behind this effect is that an equivalent weight of fine particles has a greater aggregate surface area than that of the larger particles. In the flame spraying process, the particles oxidise at the surface and, as mentioned hereinbefore, the amount of oxidised surface within the sprayed deposit has a direct bearing on the resistivity of the resulting heater element.

In producing the sprayed heater elements, a particular particle size range is used for particular applications. For example:

Toaster elements: 60–110 microns
Trouser press elements: 45–90 microns
Convector elements: 80–120 microns
Heater panels: 40–100 microns The preferred starting powder for flame spraying partially conductive coatings on substrates is an 80/20 nickel chrome alloy. During the flame spraying process, the chromium particles preferentially oxidise and form a coating of chromium oxide on the external surfaces of the nickel particles. As described above, the resistivity of the resulting sprayed coating depends on the amount of oxides present. Thus, if fine particles are in abundance, the effective oxidised area is increased and a relatively high resistance coating is obtained. Conversely, if large particles are in abundance then the effective oxidised area is reduced and a relatively low resistance coating is obtained.

However, as an alternative to simply altering the particle size, it has been found that the resistivity can be altered by blending different alloys into the powder to be sprayed, such as to alter the quantity of conductive oxides present on the sprayed particles and hence effectively to moderate the resistivity change.

Thus, by introducing alloys whose oxides are more conductive than chromium oxide, a sprayed coating of decreased resistivity can be obtained. This is illustrated in FIG. 1 of the accompanying drawings. General resistance alloys of nickel chrome or iron chrome aluminium have positive temperature co-efficients of resistance in that resistance rises with increase in temperature and these alloys exhibit the same characteristic when sprayed. However, whereas in solid wire or strip form these alloys increase in resistance by only 8/9% over a temperature rise of 1000° C., when flame sprayed to form an element, by varying the various operating parameters, this increase in resistance with temperature can be made to vary from 25% to 100% as required.

For example, as indicated by curve A in FIG. 1, an 80/20 nickel chrome powder, particle size of 45–110 microns, sprayed to give a resistance element as described above, gives an increase in resistivity from $6.5\times10^{-5}$ to $26.5\times10^{-5}$ microhm cms for a rise in temperature of 400° C. from ambient. However, by introducing a nickel cobalt iron alloy in the proportion 25% Ni Co Fe to 75% NiCr (by weight) the much flatter characteristic curve B is obtained. In this mixture, the proportion of Ni, Co and Fe in the Ni Co Fe are in the ratios 42:28:13. By using as the original powder a mixture of Ni Co Fe and Fe Cr Al in the ratio 40:60, the characteristic curve D is obtained. In this mixture, the proportions of Ni, Co and Fe in the Ni Co Fe alloy are in the ratios 42:28:13 and the proportions of Fe, Cr and Al in the Fe Cr Al alloy are 72:22:6. By using as the original powder a mixture of Ni Cr, Ni Co Fe, $Al^2O^3$ and Ni in the ratios 50:40:8:2, the characteristic curve C is obtained. In this mixture, the proportions of Ni and Cr in the Ni Cr alloy are 80:20, and the proportions of the Ni, Co and Fe in the NiCoFe alloy are 42:28:30.

Thus, the resistivity/temperature characteristic of the resistive layer resulting from the flame spraying process is moderated (compared to the resistivity level of the basic NiCr mixture) by altering the proportions of the constituents of the original mixture so as to increase the level of more conductive oxides formed around the nickel particles. Naturally, these more conductive oxides have to be selected so that they are compatible with the basic flame spraying technique. For example, conductive oxides such as copper oxide would not be used since they cannot withstand the temperatures involved.

The relatively high increase in resistance with temperature which is obtained with certain alloys can be an invaluable characteristic, as it allows elements to be made with a low initial resistance, giving a rapid heating response, but reaching a predetermined resistance for a predetermined temperature rise, thus being virtually self-limiting. One advantage of this is the simplification of control required for the heater, having the potential to eliminate the need for a thermal cut-out device, and the like.

Alternatively, by using nickel cobalt iron alloys, elements can be produced with a negative coefficient of resistance, in that resistance decreases with rise in temperature. Again, the rate of decrease of resistance with temperature can be varied by varying the spraying parameters during its formation.

The advantage of this latter type of element is in air flow heaters where an airstream is driven over the elements by a fan. With conventional elements any delay in the fan start up can cause initial overheating, whereas sprayed elements with a 'delayed' temperature buildup are not so prone. In addition, elements can be produced and 'balanced' against a particular fan output, to give a maximum power output at a predetermined operating temperature.

For still further applications, by suitably blending nickel chrome or iron chrome aluminium powders with nickel cobalt iron a deposit can be achieved with a zero temperature co-efficient of resistance.

In addition to the factors described above, it is important for the spray parameters for a given element to be accurately determined and controlled. There are six principal parameters which need to be set and these are (a) spray gun gas pressures, (b) spray time, (c) spray gun traverse speed, (d) spraying distance, (e) powder flow rate, and (f) substrate preheat time.

Of these parameters, the gas pressures used during spraying are particularly important as these can also directly affect the level of oxidation formed on the basic (usually nickel) particles and hence the resulting resistivity of the element. The two gases usually used in flame spraying are oxygen and acetylene, the ratio of oxygen to acetylene pressure affecting the degree of oxidation of the particles being sprayed and hence the resistivity of the element produced. In general, the higher the ratio, the greater the oxidation and the higher the resistivity.

A further effect of this ratio is to determine the temperature of the flame through which the particles pass, and the speed of the particle trajectory from gun to substrate. This is very important as it determines the degree of adhesion of particles to substrate and particle to particle. In general the higher the ratio, the hotter the flame and the better the adhesion.

Experience has shown that the ratio of oxygen pressure to acetylene should be within the range 1.18:1 and 1.41:1. Reversing these ratios provides a low resistance deposit, which is ideal for utilising at the ends of an element as connecting points for the incoming power. It should be noted that the use of acetylene is not essential and other oxidising gas mixture can be used.

The second parameter (b), the spray time, determines the amount of powder deposited and the basic element size. However, the continuous deposition of powder in one pass at high rates tends to produce a thick deposit with high residual stresses, leading to bad adhesion, cracking and subsequent failure. In practice it hs been found to be necessary to subdivide the calculated spray times by factors of 10 or 20 and to produce the element in a series of fast passes.

The spraying gun traverse rate, parameter (c) is determined by the time per pass and the required element area. Experience has shown that traverse rates in the range of 15 to 80 cms/sec are optimum in most cases.

The spraying distance, parameter (d), from spray gun to workpiece is decided to a large extent by the physical size of the required element. However, optimum figures in practice have been found to be between 20–50 cms.

The powder flow rate (e), determines the rate of build up of the element layer. Too high a rate gives residual stresses, too low a rate gives higher than calculated resistance.

Typical optimum powder flow rates have been found to be:

NiCr: 5–10 gms/min
FeCrAl: 7–13 gms/min
NiCoFe: 3–8 gms/min

The rates for blends of the above alloys can be extrapolated from the above data.

The preheat time (f) is important for obtaining adhesion of the sprayed layer to the substrate and has been found to be optimised at approximately 5 minutes per square meter to be sprayed, with a gas pressure ratio of 1.25:1.

Taking all of the aforegoing factors into account, it will be appreciated that, because of the wide variations of resistivity with temperature achievable by the present process, conventional resistivity theory cannot be used in the design of these new types of elements. It has been necessary to develop a series of graphical relationships of resistivity and temperature for various alloys and their particle size ranges, gas pressure ratios and other parameters. Experience then shows which graph to use for which particular type of element. However, these can be tabulated roughly as follows:

| ELEMENT TYPE: | ALLOY: (proportions as given hereinbefore) | PARTICLE SIZE RANGE: | GAS PRESSURE RATIO: |
|---|---|---|---|
| 1. High Temp. Low Area 'Toaster' Elements | NiCr. | 60–110 | 1.4:1 |
| 2. Low Temp Large Area 'Trouser Press' | NiCr NiCo Fe | 45–90 | 1.25:1 |
| 3. Convector, Large Area Low Resistance | NiCo Fe Fe, Cr, Al | 80–120 | 1.20:1 |
| 4. General Heater Panels for Industrial Furnaces | NiCr NiCo Fe + Ni & $AL_2O_3$ | 40–100 | 1.45:1 |

Experience of sprayed element production has shown that in some circumstances elements made up from single alloy powder mixtures can have definite predictable failure patterns. For example, an element made up from pure NiCr powder often fails along a line at 90° to the current path and from NiCo Fe along the current path direction. It has been found that by interspersing successive layers of nickel chrome, or iron chrome aluminium powders with one or two layers of NiCo Fe the tendency of an element to fail in one direction can be eliminated.

A number of practical advantages result from the use of sprayed on resistive elements which can be summarised as follows:

a) Sprayed elements can be produced by a fully automated process, controllable within fine tolerances, eliminating labour intensive hand operations used to manufacture a great many conventional types of element.

b) Sprayed elements can be applied to preformed, irregularly shaped substrates of any tupe of electrically insulating material, to produce a widely differing range of optimum element designs for particular purposes.

c) Sprayed elements can operate at higher power density levels than conventional wire or strip elements, such that the same heat output can be obtained from a smaller size.

d) The temperature coefficient of resistance can be varied, virtually at will, by varying the production parameters, to give elements with fast or slow heat up rates and self limiting characteristics.

e) Sprayed elements have wide current paths and localised damage, such as a hole in the element, does not automatically result in failure as it would with a conventional wire or strip element, since the current simply flows round the damaged spot. Thus, sprayed elements will withstand damage and continue to operate to far greater degree than conventional elements.

f) Tests have shown that sprayed elements are inherently safer than conventional ones, firstly because the outer surface is invariably a metallic oxide, having better insulating properties than a bare wire or strip but mainly because having a much greater surface area the current densities are far less. For example, a conventional 4 kw element, operating from a 240 volt supply, would use a wire 0.092" diameter. A one inch length of this element, carrying a current of 16.67 amps would have an area of 0.7718 $in^2$ giving a current density of 21.60 amps per square inch. An equivalent one inch length of a sprayed element has an area of 2.356 $in^2$, giving a current density of only 7.07 amps per square inch.

g) The much greater surface area of sprayed elements, as against conventional ones of equivalent capacity, gives a far more effective heat transfer capability,. This is of great importance in applications where it is necessary to heat gas or air. In addition this heat transfer capacity can be further enhanced by cutting holes or sections out of the substrate to flow of air through as well as round the element.

Electrical contact areas for an element formed by the abovedescribed process can comprise thickened areas of low resistance NiCr, with rivets provided for connection to the power supply.

Preferably, the elements are designed to have the most direct route between the contacts, with the minimum number of curves or bends in order to obtain a uniform current distribution across the element.

A wide variety of electrical heating elements can be formed by means of the present technique, the following list being purely by way of example:

(a) toaster elements where strips of resistive material are deposited (possibly in an automated process) on a suitable thin substrate plate of mica or the like, the width of the strips being chosen in order to provide the required value of resistance, and where necessary the mica substrate is double-sided and the elements on each side thereof are electrically connected in parallel. Prior to deposition, the substrate may be grit blasted to improve the adhesion between the element and the mica substrate.

(b) cooker grill elements where the resistive material is deposited on the surface of a ceramic material, which may be glass having the appropriate properties;

(c) car windscreen heaters where the resistive material is deposited onto glass or transparent plastics sheeting;

(d) car cigar lighters, infra-red elements and the like.

In accordance with one particular embodiment of the invention, there is provided a vehicle cigar/cigarette lighter comprising a heating element formed in accordance with the present invention as described above, the heating element being resiliently pivotable about its one end so that when it is angularly displaced by the engagement therewith of a cigar/cigarette to be lighted its other end engages a fixed contact to complete an electrical circuit supplying electric power to the heating element.

Other means of using the invention are both wide and numerous.

For example, it can be used in the shaping/forming of materials into complex shapes, e.g. where it is necessary to shape sheets of material using a continuous application of heat, but where forging or the application of a naked flame is prohibited, then an element configuration could be sprayed onto the material surface, electrical energy supplied and as the heat developing warmed the sheet, then the forming process applied. This particular aspect would be suitable for vacuum forming of oxygen reactive materials, or for materials required to have an unoxidised surface finish; or even the continuous forming/shaping of materials in a protective atmosphere, like the production of a tube from strip, in a non-contaminating environment.

The invention is described further hereinafter, by way of example only, with reference to the accompanying drawings, in which.

Figure 1:
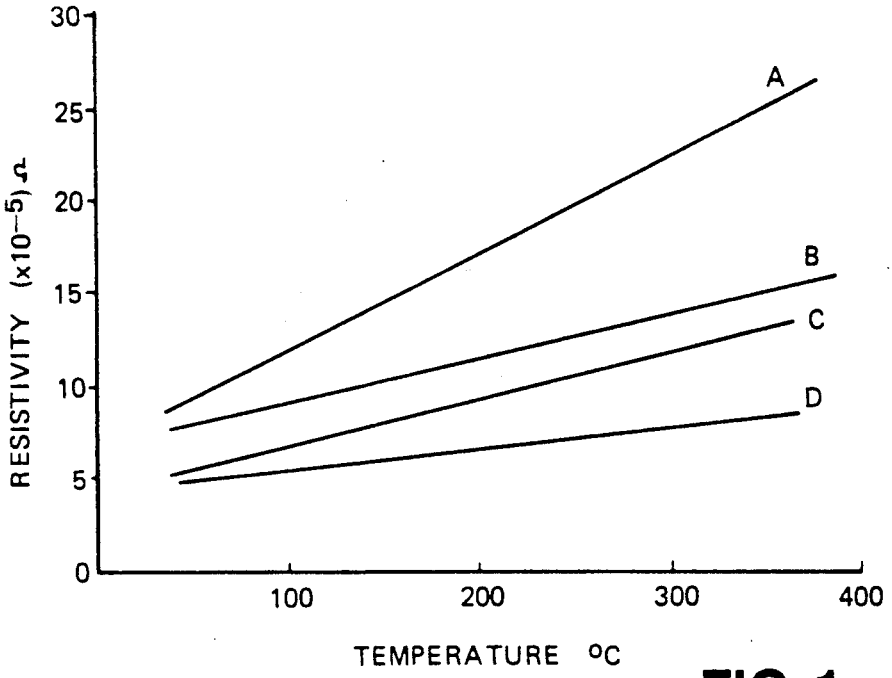
FIG. 1 shows a number of resistivity/temperature characteristics obtained using different alloy compositions in accordance with one aspect of the present invention.
Figure 4A:
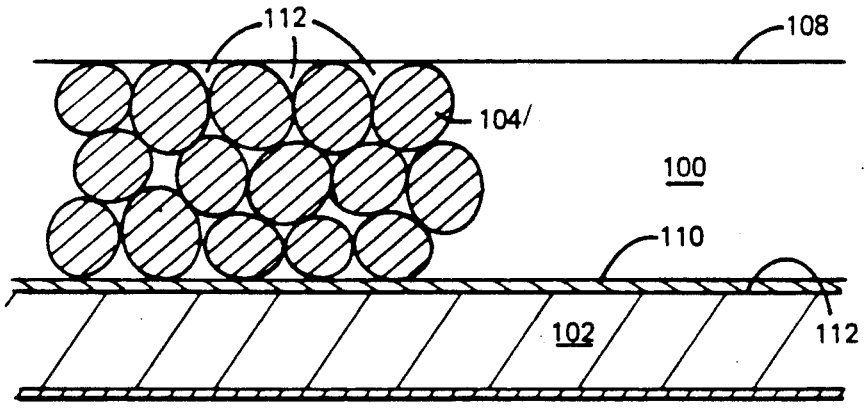
Figure 4B:
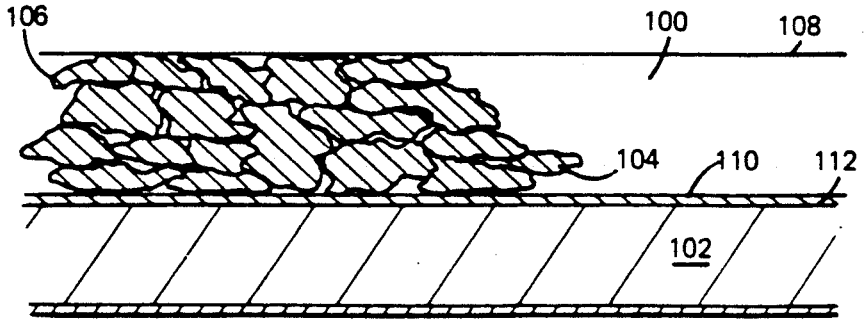

FIGS. 4*a* and 4*b* illustrate diagrammatically particle association on the substrate in conventional methods and the new method, respectively.

Figure 2:
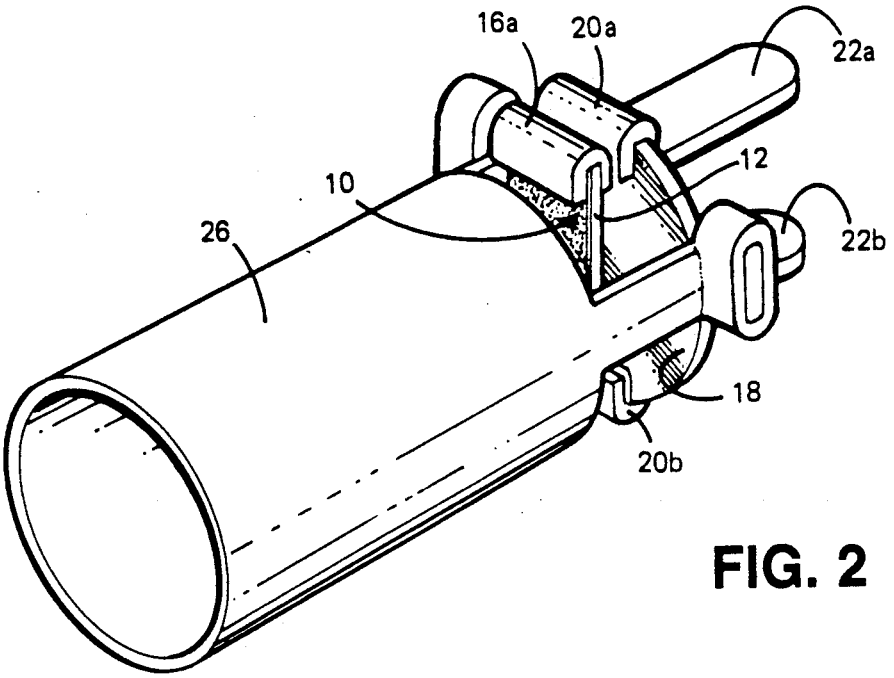
FIG. 2 is a perspective view of the embodiment of a heater device incorporating an electrical heating element formed in accordance with the method of the present invention and in the form of a cigar/cigarette lighter for use in motor vehicles.
Figure 3:
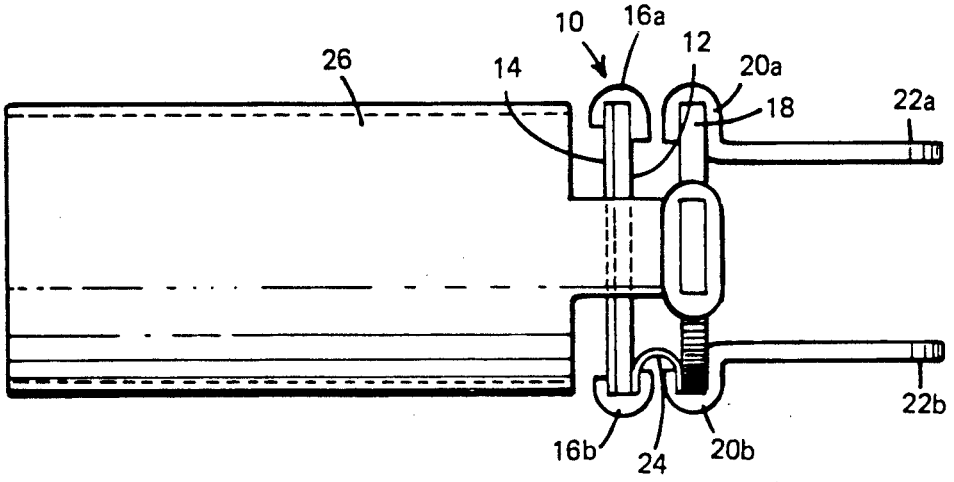
FIG. 3 is a diagrammatic side view of the device of FIG. 2.

The cigar/cigarette lighter illustrated in FIGS. 2 and 3 comprises a small heating element 10, constructed in accordance with the invention, which has been formed as described hereinbefore by depositing on a rectangular sheet 12 of mica a thin layer of a resistive material 14 consisting, for example, of Nickel-Chromium alloy powder. A respective metallic clip 16*a*, 16*b* is fitted around each of two opposite ends of the element 10 to provide electrical contacts to the resistive material 14. A further disc 18 of an electrical insulating material, such as mica, forms the base of the lighter and carries two further metallic clips 20*a*, 20*b* whose one ends are extended to form respective contact prongs 22*a*, 22*b* by which the lighter can be plugged into a suitable electrical socket (not shown) for connection to an electrical current source. As best seen in FIG. 3, a resilient flexible spring strip 24 of generally U-shaped configuration is clamped to the heating element and the base 18 by means of the clips 16*b* and 20*b* so as normally to support the heating element 10 in a plane parallel to but slightly spaced from the mica base 18. Also fastened to the mica base is a hollow tubular metallic housing 26 which acts to guide a cigar or cigarette, introduced into its lefthand end (FIGS. 2 and 3), towards the heating element 10.

It will be evident from FIG. 2 that when the end of a cigar or cigarette is pushed against the heating element 10, the latter element pivots about its spring (bottom) end (as viewed in FIG. 3) so that the clip 16*a* comes into contact with the clip 20*a* and completes the electrical circuit to the current source via the prongs 22*a*, 22*b*. Current therefore then passes through the heating element which heats up sufficiently to light the cigar or cigarette. As soon as the lighted cigar/cigarette is withdrawn, the spring moves the heating element back to the illustrated position, breaking the contact between the clips 16*a*, 20*a* and opening the circuit. The heating element therefore cools down again to await the next operation.

I claim:

1. A method of forming an electrical heating element of desired electrical resistance in the form of an electrically non-conductive supporting body onto which an electrically resistive material is deposited, the method comprising the steps:

(1) preparing a dry metal powder of irregularly shaped metal particles of widely varying sizes, within the range 20–150 microns, by blasting a molten mixture of the metal into water and subsequently crushing and drying the water atomised powder;

(2) roughening the surface of a supporting body onto which a heating element is to be formed;

(3) pre-heating said surface of the supporting body to a temperature within the range of 150°–250° C.; and (4) flame spraying the dry metal powder onto said heated surface of the supporting body in an oxidising atmosphere and in a plurality of passes over the supporting body, the effective resistance of the flame sprayed deposit being determined by controlling the amount of oxidation on the surfaces of the metallic particles sprayed onto the supporting body.

2. A method according to claim 1, wherein the amount of oxidation on the surfaces of the flame sprayed particles, and hence the resistivity of the sprayed deposit, is varied by selecting the size range of the particles used, within said range of 20–150 microns.

3. A method of forming an electrical heating element of desired electrical resistance for use in a toaster element and the like in the form of an electrically non-conductive supporting body onto which an electrically resistive material is deposited, the method comprising the steps of:

(1) preparing a dry metal powder of irregularly shaped metal particles of widely varying sizes, within the range 60–110 microns, by blasting a molten mixture of the metal into water and subsequently crushing and drying the water atomised powder;

(2) roughening the surface of a supporting body onto which a heating element is to be formed;

(3) pre-heating said surface of the supporting body to a temperature within the range of 150°–250° C.;

(4) flame spraying the dry metal powder onto said heated surface of the supporting body in an oxidising atmosphere and in a plurality of passes over the supporting body, the effective resistance of the flame sprayed deposit being determined by controlling the amount of oxidation on the surfaces of the metallic particles sprayed onto the supporting body and the amount of oxidation on the surfaces of the flame sprayed particles, and hence the resistivity of the sprayed deposit, being varied by selecting the size range of the particles used, within said range of 60–110 microns.

4. A method of forming an electrical heating element of desired electrical resistance for use as a trouser press element and the like in the form of an electrically non-conductive supporting body onto which an electrically resistive material is deposited, the method comprising the steps of:

(1) preparing a dry metal powder of irregularly shaped metal particles of widely varying sizes, within the range 45–90 microns, by blasting a molten mixture of the metal into water and subsequently crushing and drying the water atomised powder;

(2) roughening the surface of a supporting body onto which a heating element is to be formed;

(3) pre-heating said surface of the supporting body to a temperature within the range of 150°–250° C.; and (4) flame spraying the dry metal powder onto said heated surface of the supporting body in an oxidising atmosphere and in a plurality of passes over the supporting body, the effective resistance of the flame sprayed deposit being determined by controlling the amount of oxidation on the surfaces of the metallic particles sprayed onto the supporting body and the amount of oxidation on the surfaces of the flame sprayed particles, and hence the resistivity of the sprayed deposit, being varied by selecting the size range of the particles used, within said range of 45–90 microns.

5. A method of forming an electrical heating element of desired electrical resistance for use as a convector element and the like in the form of an electrically non-conductive supporting body onto which an electrically resistive material is deposited, the method comprising the steps of:

(1) preparing a dry metal powder of irregularly shaped metal particles of widely varying sizes, within the range 45–90 microns, by blasting a molten mixture of the metal into water and subsequently crushing and drying the water atomised powder;

(2) roughening the surface of a supporting body onto which a heating element is to be formed;

(3) pre-heating said surface of the supporting body to a temperature within the range of 150°–250° C.; and (4) flame spraying the dry metal powder onto said heated surface of the supporting body in an oxidising atmosphere and in a plurality of passes over the supporting body, the effective resistance of the flame sprayed deposit being determined by controlling the amount of oxidation on the surfaces of the metallic particles sprayed onto the supporting body and the amount of oxidation on the surfaces of the flame sprayed particles, and hence the resistivity of the sprayed deposit, being varied by selecting the size range of the particles used, within said range of 45–90 microns.

6. A method of forming an electrical heating element of desired electrical resistance for use as a convector element and the like in the form of an electrically non-conductive supporting body onto which an electrically resistive material is deposited, the method comprising the steps of:

(1) preparing a dry metal powder of irregularly shaped metal particles of widely varying sizes, within the range 40–100 microns, by blasting a molten mixture of the metal into water and subsequently crushing and drying the water atomised powder;
(2) roughening the surface of a supporting body onto which a heating element is to be formed;
(3) pre-heating said surface of the supporting body to a temperature within the range of 150°–250° C.; and
(4) flame spraying the dry metal powder onto said heated surface of the supporting body in an oxidising atmosphere and in a plurality of passes over the supporting body, the effective resistance of the flame sprayed deposit being determined by controlling the amount of oxidation on the surfaces of the metallic particles sprayed onto the supporting body and the amount of oxidation on the surfaces of the flame sprayed particles, and hence the resistivity of the sprayed deposit, being varied by selecting the size range of the particles used, within said range of 40–100 microns.

7. A method of forming an electrical heating element of desired electrical resistance in the form of an electrically non-conductive supporting body onto which an electrically resistive material is deposited, the method comprising the steps of:
(1) preparing a dry metal powder of irregularly shaped metal particles of widely varying sizes, within the range 20–150 microns, by blasting a molten mixture of the metal into water and subsequently crushing and drying the water atomised powder;
(2) roughening the surface of a supporting body onto which a heating element is to be formed;
(3) pre-heating said surface of the supporting body to a temperature within the range of 150°–250° C.; and
(4) flame spraying the dry metal powder onto said heated surface of the supporting body in an oxidising atmosphere and in a plurality of passes over the supporting body, the effective resistance of the flame sprayed deposit being determined by controlling the amount of oxidation on the surfaces of the metallic particles sprayed onto the supporting body and the amount of oxidation on the surfaces of the flame sprayed particles, and hence the resistivity of the sprayed deposit, being varied by blending the selected alloys into the powder to be sprayed, such as to adjust the quantity of conductive oxides present on the sprayed particles.

8. A method according to claim 7, wherein the powder sprayed consists of a nickel chromium alloy to which one or more further alloys are added for purposes of oxides adjustment.

9. A method according to claim 8, wherein the powder sprayed consists of a nickel chromium alloy to which is added NiCoFe alloy for purposes of oxides adjustment.

10. A method according to claim 8, wherein the powder sprayed consists of a nickel chromium alloy to which NiCoFe, $Al_2O_3$ and Ni are added for purposes of oxides adjustment.

11. A method according to claim 8, wherein the powder sprayed consists of a mixture of NiCoFe and FeCrAl.

12. A method of forming an electrical heating element of desired electrical resistance in the form of an electrically non-conductive supporting body onto which an electrically resistive material is deposited, the method comprising the steps of:
(1) preparing a dry metal powder of irregularly shaped metal particles of widely varying sizes, within the range 20–150 microns, by blasting a molten mixture of the metal into water and subsequently crushing and drying the water atomised powder;
(2) roughening the surface of a supporting body onto which a heating element is to be formed;
(3) pre-heating said surface of the supporting body to a temperature within the range of 150°–250° C.; and
(4) flame spraying the dry metal powder onto said heated surface of the supporting body in an oxidising atmosphere and in a plurality of passes over the supporting body, said flame spraying being carried out in an oxygen/acetylene flame spraying gun, the ratio of oxygen pressure to acetylene pressure being within the range 1.18:1 and 1.45:1.

13. A method according to claim 12, wherein the flame spraying gun is moved in a series of passes over the supporting body at a speed in the range 15 to 80 cms/sec.

14. A method according to claim 1, wherein successive layers of flame sprayed NiCr or FeCrAl powders are interspersed on the supporting body with flame sprayed layers of NiCoFe powder.

15. A heating element when formed by the method of any of claims 1 to 14.

16. A vehicle cigar/cigarette lighter comprising a heating element formed in accordance with the method of claim 1, the heating element being resiliently pivotable about its one end so that when it is angularly displaced by the engagement therewith of a cigar/cigarette to be lighted its other end engages a fixed contact to complete an electrical circuit supplying electric power to the heating element, and wherein an electrically insulating body carries a pair of metallic clips whose one ends are extended to form respective contact terminations by which the lighter can be plugged into a suitable electric socket, the heating element being in the form of a disc having a respective further metal clip fitted around diametrically opposite ends to provide electrical contacts to the resistive material, and a resilient flexible electrically conductive strip interconnecting one of the clips on the heating element with one of the clips on the insulating body.

17. A method of forming an electrical heating element of desired electrical resistance in the form of an electrically non-conductive supporting body onto which an electrically resistive material is deposited, the method comprising the steps of:
(1) preparing a dry metal powder of irregularly shaped metal particles of widely varying sizes, lying within the range 20–150 microns, by blasting a molten mixture of the metal into water and subsequently crushing and drying the resulting water-atomised powder;
(2) roughening the surface of a supporting body onto which a heating element is to be formed;
(3) pre-heating said surface of the supporting body to a temperature within the range of 150°–250° C.;
(4) flame spraying the dry metal powder onto said heating surface of the supporting body in a plurality of passes over the supporting body, the flame spraying step being carried out in an oxidising atmosphere so that metal oxides are deposited on the supporting body, the effective resistance of the flame sprayed deposit being determined in dependence upon the level of oxidation of the metal particles of the powder.

* * * * *